US007420525B2

(12) United States Patent
Colburn et al.

(10) Patent No.: US 7,420,525 B2
(45) Date of Patent: Sep. 2, 2008

(54) MULTI-BEAM ANTENNA WITH SHARED DIELECTRIC LENS

(75) Inventors: Joseph S. Colburn, Malibu, CA (US); Hui-Pin Hsu, Northridge, CA (US); Osman D. Altan, Northville, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 1 day.

(21) Appl. No.: 11/685,812

(22) Filed: Mar. 14, 2007

(65) Prior Publication Data

US 2007/0296640 A1 Dec. 27, 2007

Related U.S. Application Data

(60) Provisional application No. 60/805,620, filed on Jun. 23, 2006.

(51) Int. Cl.
*H01Q 19/06* (2006.01)

(52) U.S. Cl. ..... 343/911 L; 343/753; 343/754; 343/911 R

(58) Field of Classification Search ..... 343/753, 343/754, 909, 911 L, 911 R, 755, 783, 853
See application file for complete search history.

(56) References Cited

U.S. PATENT DOCUMENTS

| | | | | |
|---|---|---|---|---|
| 4,488,156 | A * | 12/1984 | DuFort et al. | 343/754 |
| 6,137,434 | A | 10/2000 | Tohya et al. | |
| 6,356,247 | B1 * | 3/2002 | Hirtzlin et al. | 343/911 L |
| 6,424,319 | B2 * | 7/2002 | Ebling et al. | 343/911 L |
| 7,042,420 | B2 | 5/2006 | Ebling et al. | |
| 7,301,504 | B2 * | 11/2007 | Howell et al. | 343/754 |

* cited by examiner

*Primary Examiner*—Tho G Phan

(57) ABSTRACT

An integrated multi-beam antenna with a shared dielectric lens is disclosed. The antenna is formed by positioning the feed apertures of a plurality of waveguide feeds at positions located on the surface of the shared dielectric lens. The angular direction and shape of radiation beams produced by the waveguide feeds are determined by the physical and dielectric characteristics of the lens, the location of feed apertures of the waveguide feeds on the surface of the lens, and the frequency of electromagnetic energy propagating in the waveguide feeds. The principles of the invention are applied to realize an inexpensive, integrated multi-feed antenna adapted to provide desired angular areas of coverage for both a long range and short range radar in an automotive radar safety system.

20 Claims, 7 Drawing Sheets

Table 1

| Beam | Azimuth Angle (deg.) | Directivity (dB) | Azimuth Beamwidth (deg.) | Elevation Beamwidth (deg.) |
|---|---|---|---|---|
| A1 | -14.5 | 26.1 | 8.6 | 10.0 |
| A2 | -23.9 | 26.0 | 9.3 | 9.2 |
| A3 | -35.6 | 25.6 | 9.5 | 9.5 |
| A4 | -45.5 | 25.7 | 9.1 | 9.2 |
| A5 | -55.3 | 25.3 | 10.6 | 9.1 |
| A6 | -65.5 | 25.4 | 10.9 | 9.0 |
| A7 | -75.3 | 25.2 | 9.6 | 9.0 |

*FIG. 6A*

Table 2

| Beam | Azimuth Angle (deg.) | Directivity (dB) | Azimuth Beamwidth (deg.) | Elevation Beamwidth (deg.) |
|---|---|---|---|---|
| B1 | 16.9 | 26.0 | 8.4 | 9.5 |
| B2 | 26.0 | 25.9 | 9.6 | 9.4 |
| B3 | 35.7 | 25.9 | 9.4 | 9.2 |
| B4 | 45.9 | 25.5 | 9.4 | 9.4 |
| B5 | 55.8 | 25.2 | 10.1 | 9.3 |
| B6 | 65.9 | 25.4 | 9.9 | 9.1 |
| B7 | 75.2 | 25.1 | 9.8 | 9.1 |

*FIG. 6B*

Table 3

| Beam | Azimuth Angle (deg.) | Directivity (dB) | Azimuth Beamwidth (deg.) | Elevation Beamwidth (deg.) |
|---|---|---|---|---|
| C4 | -6.3 | 33.3 | 3.4 | 3.4 |
| C2 | -4.0 | 32.9 | 3.4 | 3.4 |
| C1 | 0 | 33.4 | 3.3 | 3.5 |
| C3 | 2.9 | 33.1 | 3.3 | 3.3 |
| C5 | 6.0 | 32.3 | 3.3 | 3.3 |

*FIG. 6C*

MULTI-BEAM ANTENNA WITH SHARED DIELECTRIC LENS

CROSS REFERENCE TO RELATED APPLICATIONS

This application claims priority to US provisional patent application Ser. No. 60/805,620 filed on Jun. 23, 2006 which is hereby incorporated herein by reference.

TECHNICAL FIELD

The present invention is related to antennas, and more particularly, to a multi-beam antenna having a shared dielectric lens.

BACKGROUND OF THE INVENTION

Radar based safety systems for automobiles require directional antennas capable of distinguishing targets in a wide field of view in front of vehicles. It has been found advantageous to provide such safety systems with both short and long range radar coverage, where the antenna requirements differ for each type of radar coverage. For long range radar coverage extending from about −7.5° to about 7.5° in azimuth in front of a vehicle, radar antenna beamwidths of about 3° to 4° have been found effective for radiation beams in this angular area of coverage. For short range radar coverage extending from about −80° to 80° in azimuth (except for the coverage area of the long range radar), radar antenna beamwidths of about 10° have been found effective for radiation beams within this angular area of coverage.

In the past, up to five separate antenna structures with different apertures have been required to provide the necessary radiation beams within the individual areas of angular coverage for both a long range radar operating at 77 GHz, and a short range radar operating at 24 GHz. These separate antennas take up a significant amount of space on a vehicle, and can be relatively expensive as compared to other radar system components.

Accordingly, there exists a need for an inexpensive, integrated multi-beam antenna that can provide multiple radiation beams within specified areas of angular coverage for both short and long range radars in automotive radar safety systems.

SUMMARY OF THE INVENTION

The Applicants have found that a multi-beam antenna having a plurality of radiation beams, with each radiation beam having a shape and an angular direction defined relative to the antenna, can be fabricated by combining a dielectric lens with an antenna feed configuration comprising a plurality of waveguide feeds. The dielectric lens has specific physical and dielectric characteristics. The waveguide feeds each have a physical structure for supporting the propagation of electromagnetic energy at a selected frequency, and opposing ends with one end opening into a feed port and the other end defining a feed aperture contiguous with the dielectric lens at a defined position along the surface of the lens.

In forming the multi-beam antenna in this way, the Applicants have found that the shape and angular direction of the radiation beams of the antenna can be adjusted based upon the physical and dielectric characteristics of the lens, the position of the feed apertures along the surface of the dielectric lens, and the selected frequencies at which electromagnetic energy propagates in the waveguide feeds.

According to one embodiment, the dielectric lens is formed to approximate the focusing properties of a Luneburg lens. Preferably, this is accomplished by forming the dielectric lens from a material having a relative dielectric constant in the range from about 2.0 to 3.0 in a generally spherical shape with a surface defined by the diameter of the dielectric lens. In a preferred embodiment of the multi-beam antenna, the dielectric lens is formed from a known material referred to as Delrin®, which has a relative dielectric constant of about 2.5 at operational frequencies of the multi-beam antenna.

According to another embodiment, the antenna feed configuration can be realized by a metallic structure containing the plurality of waveguide feeds, where each waveguide feed is formed as an electrically conducting channel within the metallic structure. The metallic structure is shaped to interface with the dielectric lens so the feed aperture of each of the waveguide feeds is contiguous with be surface of the dielectric lens.

According to yet another embodiment, the angular direction of each of the radiation beams is determined by the position of the feed aperture of a corresponding one of the waveguide feeds on the surface of the dielectric lens. The shape of each of the radiation beams is defined by an associated half power beamwidth, which is determined by the diameter of the dielectric lens and the selected frequency of electromagnetic energy propagating in the corresponding one of the waveguide feeds.

The principles of the present invention were applied to provide an exemplary multi-beam antenna adapted to satisfy the angular coverage requirements of the above described automotive radar safety system.

This was accomplished by providing a first set of waveguide feeds for propagating electromagnetic energy at a first frequency of about 77 GHz, and a second set of waveguide feeds for propagating electromagnetic energy at a second frequency of about 24 GHz.

The feed apertures of the first set of waveguide feeds were centered at different position along a circular arc on the surface of the dielectric lens to provide a first group of overlapping radiation beams having defined angular directions in the required area of angular coverage for the long range radar. The apertures of the second set of waveguide feeds were centered at different positions along the same circular arc on the surface of the dielectric lens to provide a second set of overlapping radiation beams having defined angular directions in the required area of angular coverage for the short range radar.

The diameter of the spherical shaped dielectric lens was selected to be about 3.0 inches (7.63 cm), thereby establishing a half power beamwidth of approximately 3.4° for each radiation beam in the first group, and a half power beamwidth of approximately 9.5° for each radiation beam in the second group.

The feed configuration was fashioned to have five waveguide feeds in the first set and fourteen waveguide feeds in the second set. The feed apertures of the five waveguide feeds in the first set were centered at different positions along a defined circular arc on the surface of the dielectric lens to provide a first group of corresponding radiation beams at angular directions of −6°, −3°, 0°, 3°, and 6° in an azimuthal plane defined relative to the multi-beam antenna. The azimuthal plane being a virtual plane that passing through the center of the spherical shaped dielectric lens and contains the defined circular arc on the surface of the dielectric lens. The feed apertures of the fourteen waveguide feeds in the second set were centered at different positions along the same defined circular arc to provide a second group of corresponding radiation beams at angular directions of −75°, −65°, −55°, −45°, −35°, −25°, −15°, 15°, 25°, 35°, 45°, 55°, 65°, and 75° in the azimuthal plane.

By selecting this number and placement of the waveguide feeds, adjacent radiation beams in a first area of angular coverage (extending from about −7.5° to 7.5°), and in a second area of angular coverage (extending from about −80° to −7.5° and 7.5° to 80°) were made to approximately overlap at their respective half power beamwidths.

Accordingly, an inexpensive, integrated multi-beam antenna that satisfies the angular coverage requirements of the short and long range radars of the above described automotive radar safety system is realized.

BRIEF DESCRIPTION OF THE DRAWINGS

The present invention will now be described in the following detailed description with reference to the accompanying drawings. Like reference characters designate like or similar elements throughout the drawings in which:

FIGS. 6A-6C presents Tables 1-3 containing the measured beam angular direction in azimuth, the directivity, and the azimuth and elevation beamwidths for each of the radiation beams corresponding to the individual waveguide feeds of the multi-beam antenna shown in FIG. 1.

DESCRIPTION OF THE PREFERRED EMBODIMENT

A Luneburg lens is a spherical lens formed of a non-homogeneous medium, which is known to have perfect focusing properties. One form of the Luneburg lens has a relative dielectric constant of $\in_r=2$ at its center, which gradually decreases to $\in_r=1$ as its outer surface in accordance with the relationship $\in_r=2-R^2$, where R represents the radial distance from the center of a unit radius sphere. This type of lens is known to have one focal point on its spherical surface, with the other focal point at infinity in a direction away from the opposite side of the sphere on a line defined by the surface focal point and the sphere center. Perfect Luneburg lens are difficult to make in practice, and approximate versions having stepped changes in their dielectric constant formed by concentric hemispherical shells of different dielectrics are known in the art; however, these configurations are relatively expensive to manufacture.

The Applicants have recognized that a solid spherical dielectric lens having a uniform relative dielectric constant $\in_r$ in the range of about 2.0 to 3.0 can provide a reasonable and practical approximation to the perfect focusing properties of the Luneburg lens for cost effective antenna construction. With this recognition, and the principles disclosed in the specification that follows, the Applicants have found a cost effective way of fabricating integrated multi-beam antennas, which can be adapted to satisfy the requirements of the automotive radar safety system described above, as well as other multi-beam antenna applications.

Figure 1:
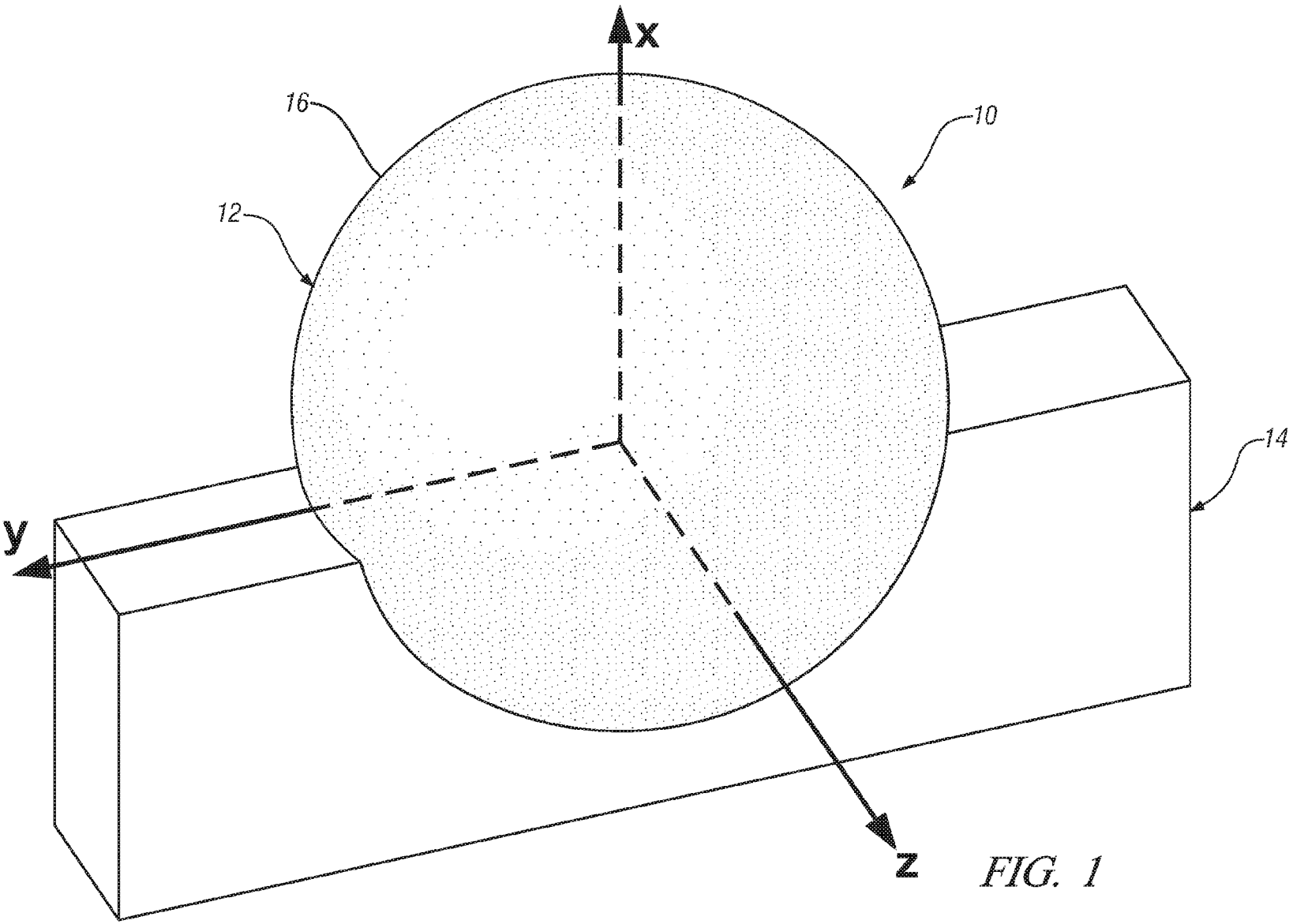
FIG. 1 is a perspective view of an embodiment of a multi-beam antenna in accordance with the present invention.

Referring now to FIG. 1, there is shown an embodiment of a multi-beam antenna according to the present invention, which is generally designated by the numeral 10. The multi-beam antenna 10 comprises a dielectric lens generally designated as 12, and an antenna feed configuration generally designated as 14. Also shown are x, y, and z-axes of a virtual rectangular coordinate system having its origin at the center of lens 12. This coordinate system will be used throughout the present specification for directional reference.

Dielectric lens 12 has defined physical and dielectric characteristics. For this exemplary embodiment of the invention, dielectric lens 12 has a substantially spherical surface 16, where its physical size is then determined by its diameter. A standard sized 3.0 inch (7.63 cm) in diameter Delrin® sphere was used to realize the dielectric lens 12. As will be subsequently explained, the size of the diameter of spherical dielectric lens 12 is an important factor determining the shape of the radiation beams produced by multi-beam antenna 10.

The Delring material forming dielectric lens 12 is known to have a relative dielectric constant $\in_r$ of about 2.5 at the operating frequencies of interest for exemplary multi-beam antenna 10. Accordingly, dielectric lens 12 then has focusing properties reasonably approximating those of a Luneburg lens. It will also be understood that dielectric lens 12 could also have the form of an ideal Luneburg lens, or a stepped dielectric version, if increased cost and complexity in fabricating the multi-beam antenna is acceptable for its particular application.

Figure 2:
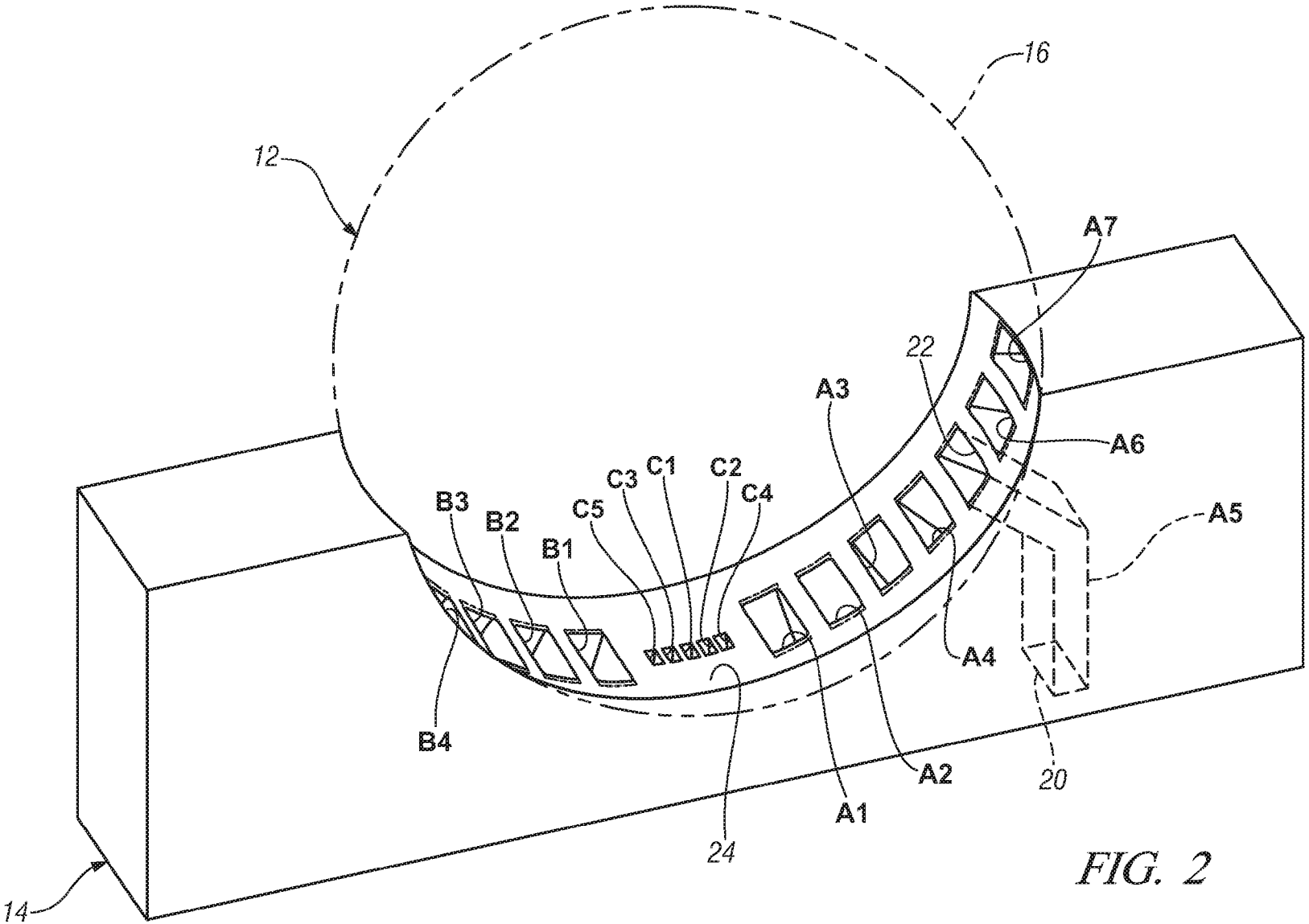
FIG. 2 shows a partially transparent perspective view of the multi-beam antenna of FIG. 1, with the dielectric lens shown as being transparent to illustrate the structure of the antenna feed configuration.

Referring now to FIG. 2, there is shown a peripheral view of the antenna feed configuration 14 of multi-feed antenna, with the dielectric lens 12 shown as being transparent. The antenna feed configuration 14 is comprised of a plurality of waveguide feeds (or channels) designated as A1-A7, B1-B7, and C1-C5. Waveguide feeds B5, B6, and B7 are hidden from view, but are located symmetrically opposite the respective waveguide feeds A5, A6, and A7 on surface 24. In this exemplary embodiment of the invention, each of these waveguide feeds has a physical structure used in standard waveguide construction.

The waveguide feeds A1-A7, B1-B7, and C1-C5 have the form of waveguide structures comprising electrically conducting channels with defined cross-sectional shapes and dimensions for supporting the propagation of electromagnetic energy in defined frequency bands. For the exemplary embodiment shown in FIG. 2, the waveguide feeds A1-A7, B1-B7, and C1-C2 have the form of standard rectangular waveguide, where the cross-sectional area and dimensions of the waveguide feeds C1-C7 are shown as being significantly less than that of waveguide feeds A1-A7, and B1-B7. Generally, waveguide structures having smaller cross-sectional areas support the propagation of electromagnetic energy at higher frequencies.

For the present embodiment, the antenna feed configuration 14 was a metallic structure fabricated from a shaped block of aluminum, in which the waveguide feeds A1-A7, B1-B7, and C1-C5 were formed by machining. The channels of the waveguide feeds were milled in two separate matching blocks of aluminum using a computer controlled milling machine. The two separate blocks were then bolted together to form the completed metallic structure of antenna feed configuration 14. It will also be recognized that antenna feed configuration 14 could be fabricated by metal coating waveguides feeds formed in an injection molded plastic structure, or by using individual sections of standard rectangular waveguide held in position by any know kind of retaining assembly.

For ease of illustration, further features of the waveguide feeds A1-A7, B1-B7, and C1-C5 will now be described, by way of example, using only waveguide feed A5. The hidden portion of waveguide feed A5 in the feed configuration 14 is shown by the dotted lines. It will be understood that waveguide feed (or channel) A5 has two opposing open-ends 20 and 22. Open-end 20 will be referred to hereinafter as a feed port, and open-end 22 will be referred to hereinafter as a feed aperture, which is contiguous with the spherical surface 16 of the dielectric lens 12. In what follows, the similarly situated open-ends of the other waveguide feeds A1-A4, A6-A7, B1-B7, and C1-C5 will be referred to as the feed ports and feed apertures of the respective waveguide feeds.

For this exemplary embodiment of the invention, the surface 24 of the antenna feed configuration 14 is shaped by machining to correspond to the interfacing spherical surface 16 of the dielectric lens 12. It will be recognized that antenna feed configuration 14 will also serve as a holder for dielectric lens 12. The dielectric lens 12 and antenna feed configuration 14 can be bonded together using an appropriate adhesive, or other fastening means to form the integrated structure of multi-beam antenna 10. It will also be recognized that the surface 24 of antenna feed configuration 24 could be machined to take a simpler cylindrical form if antenna feed configuration 14 is sufficiently narrow in width (in the z-direction of FIG. 1).

Figure 3:
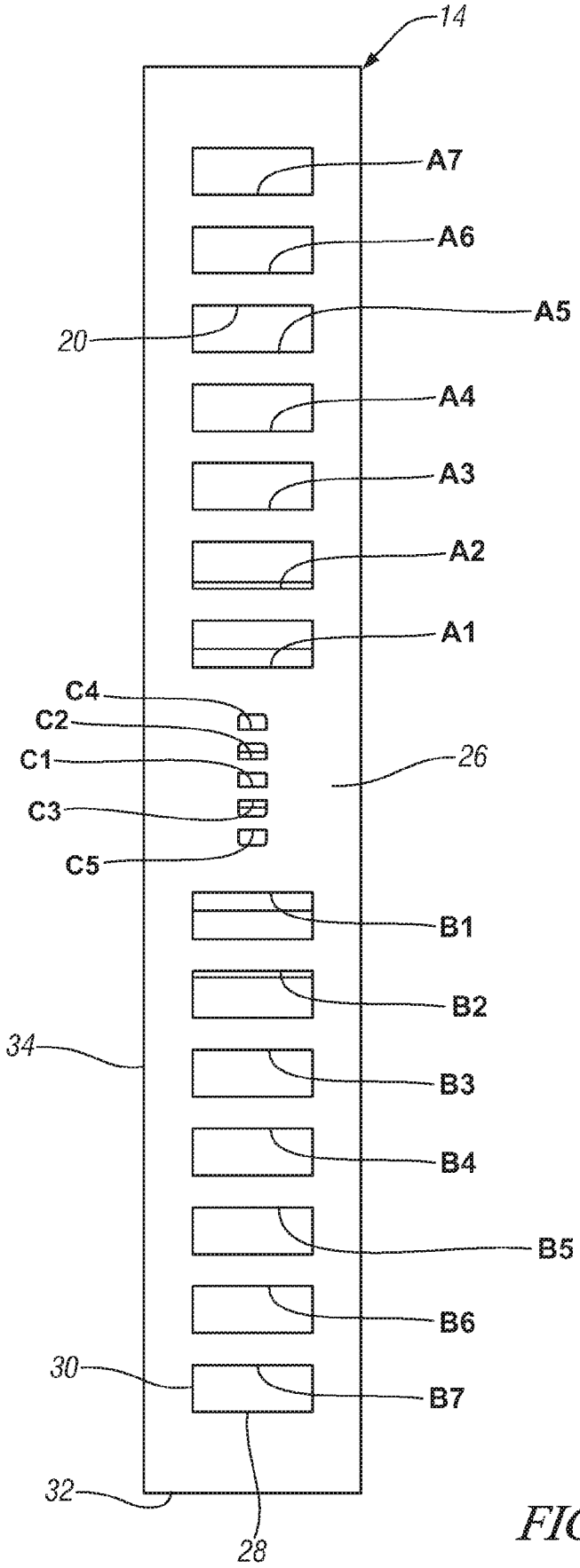
FIG. 3 shows a bottom plan view of the antenna feed configuration of FIG. 1 illustrating the different feed ports of the waveguide feeds.

FIG. 3 shows a plan bottom view of antenna feed configuration 14, illustrating all of the feed ports for the various waveguide feeds A1-A7, B1-B7, and C1-C5 on the bottom surface 26 of antenna feed configuration 14. As explained previously, each of the feed ports is also connected by way of a rectangular shaped channel to its corresponding feed aperture on the opposite surface 24 of antenna feed configuration 14.

Antenna feed configuration 14 is shown as having a first side 32 representing its width, and a second side 34 representing its length (each being respectively parallel to planes containing the x and z-axes, and the x and y-axes of FIG. 1). The rectangular shaped channel of waveguide feed B7 is shown as having a short wall 30 representing the channel height, and a long wall 28 representing the channel width. It will be understood that the rectangular shaped channels of each of the other waveguide feeds A1-A7, B1-B6, and C1-C5 have corresponding short and long walls, but these have not been specifically referenced by number to avoid confusion and simplify the drawings.

In this exemplary embodiment of the invention, the channels of waveguide feeds A1-A7, B1-B7, and C1-C5 are oriented such that their short walls are in parallel alignment with the plane containing the x and y-axes of FIG. 1. As will be subsequently discussed, this alignment has significance in that the dominant propagation mode for electromagnetic energy in a rectangular shaped waveguide is the $TE_{10\ mode}$, whereby the electric field is essentially parallel to the short wall having the smaller dimension. Accordingly, the orientation of the short walls and long walls of waveguide feeds A1-A7, B1-B7, and C1-C5 with respect to the feed configuration 14 will determine the polarization of the radiation beams of multi-beam antenna 10.

It will also be understood that the bottom surface 26 of the antenna feed configuration 14 can be appropriately drilled and tapped (not shown) for easy connection of external waveguide sections to the respective feed ports of the waveguide feeds A1-A7, B1-B7, and C1-C5. Those skilled in the art will also recognize that antenna feed configuration 14 can also be connected directly to a circuit board containing strip-line, co-planar waveguide, and other types of microwave circuitry by providing the appropriate transitions to the various waveguide feeds A1-A7, B1-B7, and C1-C5. See for example, the publication to Wilfried Grabherr, Bernhard Huder, and Wolfgang Menzel, "Microstrip to Waveguide Transition Compatible With MM-Wave Integrated Circuits," IEEE Trans. Microwave Theory Tech., vol. 42, pp. 1843-1843, September 1994, which is hereby incorporated by reference.

Figure 4:
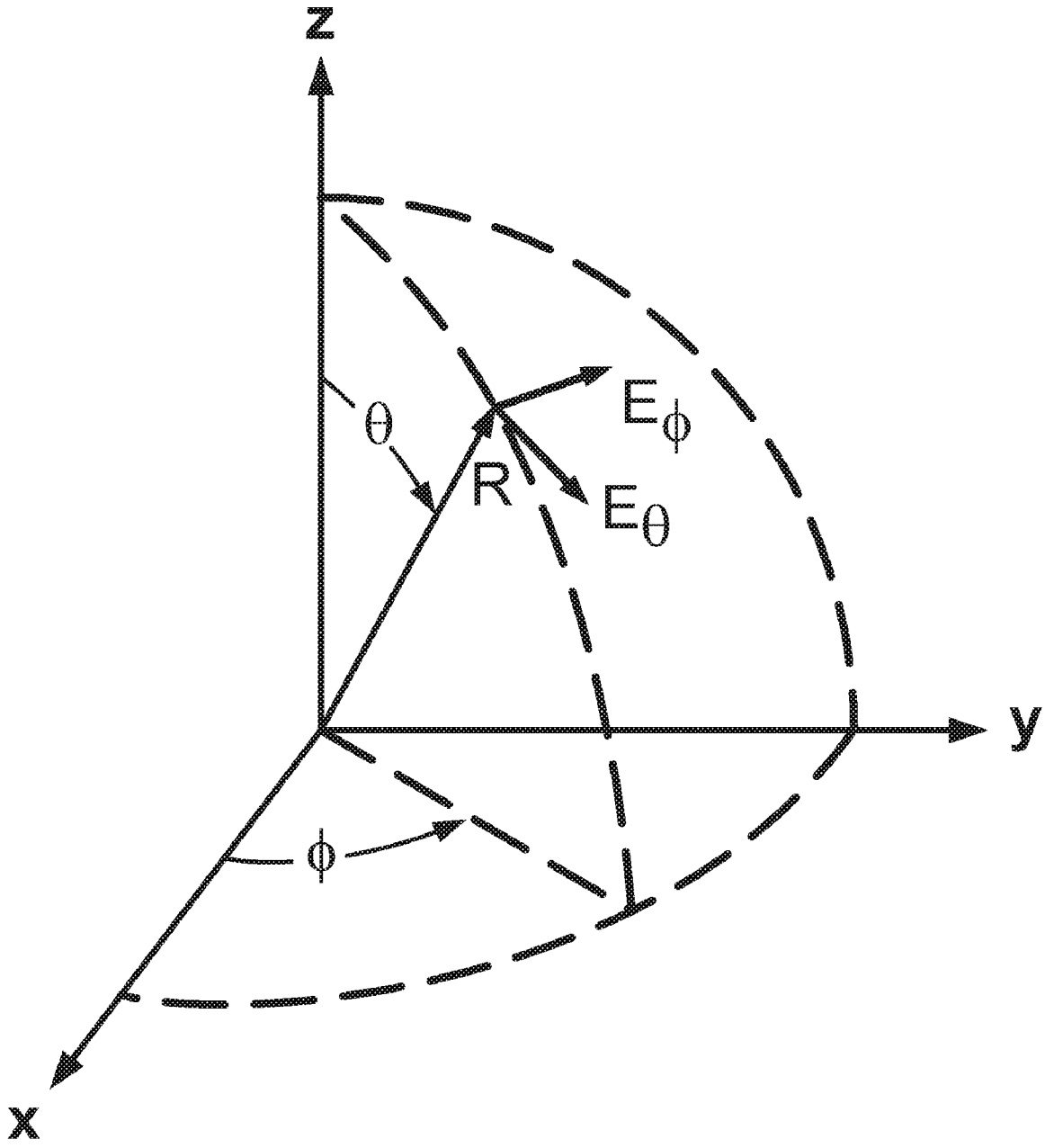
FIG. 4 illustrates a rectangular coordinate system and spherical angles useful in describing the radiation beams of the exemplary multi-beam antenna of FIG. 1.

Referring now to FIG. 4, there is shown a rectangular coordinate system having the same x, y, and z-axes previously illustrated in FIG. 1, with the addition of spherical angles $\theta$ and $\phi$ that will be used in describing the radiation patterns or radiation beams of multi-beam antenna 10. As is well known, angular plots of such radiation patterns define the gain or magnitude of radiation beams for an antenna structure located at the origin, in angular directions R away from the antenna, as defined by the angles $\theta$ and $\phi$. Antenna gain is proportional to the square of the magnitude of the differently polarized electric field components $E_\theta$ and $E_\phi$ of the electromagnetic energy being propagated away from the antenna when it acts as a radiator.

For the purpose of describing the radiation beams of exemplary multi-beam antenna 10, the plane containing the x and y-axes will be referred to as the azimuthal plane, where multi-beam antenna 10 is considered to be located above the earth (as for example, on the front or rear surface of an automobile) with the azimuthal plane then being above and parallel to the surrounding surface of the earth. In terms of the spherical angles $\theta$ and $\phi$ of FIG. 4, directions in the azimuthal plane are then defined by fixing the angle $\theta=90°$, where the angle $\phi$ then defines angles in azimuth. In what follows, specific angle in azimuth will be referred to as the azimuthal angle $\phi_A$. It will be understood that the angular direction defined by $\phi_A=0°$ represents the x-axis, with $\phi_A$ increasing in positive value for increasing counter-clockwise rotation about the z-axis. When referring to angles $\phi_A$ in azimuth, it is also common in the antenna art to make reference to elevation angles or angles in elevation, which will subsequently be referred to as $\theta_E$. Elevation angles $\theta_E$ are defined in terms of the spherical angle $\theta$ illustrated in FIG. 4, where $\theta_E=(90-\theta)$. For example, an elevation angle of $\theta_E=10°$ corresponds to the spherical angle $\theta=80°$. It will also be understood that in the azimuthal plane (defined by $\theta_E=0°$), it is also common to refer to the above mentioned polarized electric field components $E_\theta$ and $E_\phi$ as respectively being vertical polarized and horizontal polarized. These angular conventions will be used in the subsequent description of the radiation patterns or radiation beams of the present invention, where reference to the angular direction of such a radiation beam will be understood by those skilled in the art to mean the direction of the beam axis of the principal lobe of the radiation beam where radiation intensity is at a maximum.

Referring again to FIGS. 1-3, it will be recognized that dielectric lens 12 functions as a shared antenna aperture for electromagnetic energy propagating to and from the waveguide feeds A1-A7, B1-B7, and C1-C5 via their respective feed apertures positioned contiguous to the surface of dielectric lens 12 with their centers located in the azimuthal plane. It will also be recognized that when the dimensions of these feed apertures are relatively small compared to the diameter of dielectric lens 12, such waveguide feed apertures will approximate point sources or receivers of the propagating electromagnetic energy. Due to the previously described focusing properties of dielectric lens 12, each such waveguide feed aperture will then have an associated radiation beam with its maximum magnitude in a direction away from dielectric lens 12 defined by a line passing through its spherical center and the center of the associated waveguide feed aperture. Accordingly, the plurality of waveguide feeds A1-A7, B1-B7, and C1-C5 act in conjunction with dielectric lens 12 to produce a corresponding plurality of such radiation beams in angular directions around multi-beam antenna 10 in the azimuthal plane.

As indicated previously, it has been found advantageous to have antennas for automotive radar applications that provide a first area of angular coverage for a long range radar extending from about −7.5° to about 7.5° in azimuth, with radiation beams having beamwidths of about 3° to 4° within this first area of angular coverage, and a second area of angular coverage for a short range radar extending from about −80° to 80° in azimuth (excluding the angular area covered by the long range radar), with radiation beams having beamwidths of about 10° in this second area of angular coverage. As indicated previously, up to five separate antenna structures with different apertures have been required in the past to provide the necessary coverage for both a long range radar operating at 77 GHz and a short range radar operating at 24 GHz.

Referring again to FIGS. 1-3, the Applicants have found that the exemplary embodiment of multi-beam antenna 10 can be used to achieve the above short and long range radar coverage requirements. This was accomplished by selectively locating the centers of the feed apertures of waveguide feeds A1-A7, B1-B7, and C1-C5 at predetermined positions along the surface of the dielectric lens 12. It will be recognized from FIG. 2 that due to the symmetrical placement of the waveguide feed apertures on antenna feed configuration 14, the feed apertures are positioned along a circular arc (not shown) along the spherical surface 16 of dielectric lens 12 (in the or x-y plane). Accordingly, each waveguide feed aperture acts as a radiator or receiver of electromagnetic energy propagating through dielectric lens 12, and has a corresponding radiation beam with its maximum gain (or radiation magnitude) in an angular direction away from dielectric lens 12 defined by a line passing through the centers of the waveguide feed aperture and the dielectric lens 12.

It will also be recognized that the above referenced circular arc lies in the azimuthal plane (i.e., the x-y plane), and represents a portion of the circle defined by the intersection of the spherical surface 16 with the azimuthal plane, which passes through the center of dielectric lens 12. Accordingly, in what follows, angles of azimuth $\phi_A$ can be used to describe the locations of the centers of the feed apertures of waveguide feeds A1-A7, B1-B7, and C1-C5 on the spherical surface 16 of dielectric lens 12, and also for the angular directions of the maximum gain or magnitude of the correspond radiation beams produced by these waveguide feed apertures.

The Applicants have found that the long range radar coverage requirements for the above described vehicle safety system can be satisfied by employing a first group of five radiation beams, where such beams each have a beamwidth of about 3°, and are directed to have their respective maximums in angular directions of $\phi_A$=−6°, −3°, 0°, 3°, and 6° in the azimuthal plane. In this way, adjacent pairs of the radiation beams essentially overlap at their respective half power or 3 dB beamwidth points in the azimuthal plane to provide the necessary long range radar coverage from $\phi_A$=−7.5° to 7.5°. Similarly, the short range radar coverage requirements can be satisfied by employing a second group of fourteen radiation beams, each having a half power beamwidth of about 10°, where the beams are directed to have their respective maximums in angular directions at $\phi_A$=−75°, −65°, −55°, −45°, −35°, −25°, −15°, 15°, 25°, 35°, 45°, 55°, 65°, 75° in the azimuthal plane.

It will be understood that in the exemplary embodiment of the invention shown in FIGS. 1-3, the above required radiation beams are produced by positioning the centers of the waveguide feed apertures at locations contiguous to the surface of dielectric lens 12 in directions directly opposition those of the desired or required beam maximums (i.e., at the above azimuth angles defining the beam maximums, each increased by 180°). Accordingly, the angular locations of the feed aperture centers for a first set of waveguide feeds C5, C3, C1, C2, and C4 are respectively located along the circular arc on the surface 16 of dielectric lens 12 at azimuth angles $\phi_A$=174°, 177, 180°, 183°, and 186° to satisfy the beam directions for the long range radar coverage requirements. Similarly, the feed aperture centers for a second set of waveguide feeds A1-A7 and B1-B7 are respectively located along the same circular arc on the surface 16 of dielectric lens 12 at the azimuth angles $\phi_A$=195°, 205°, 215°, 225°, 235°, 245°, 255°, 165°, 155°, 145°, 135°, 125°, 115°, 105° to satisfy the beam angular directions for the short range radar requirements.

If the positions or locations along the circular arc are defined in terms an arc angle $\phi_C$, where such arc angles are defined by the relationship $\phi_C=\phi_A-180°$, then center of the circular arc will occur where $\phi_C$=0°, and the arch angle $\phi_C$ can then be used to define other locations along the arc. Thus, it will be understood that the centers of the feed apertures of the waveguide feeds B7, B6, B5, B4, B3, B2, B1, C5, C3, C1, C2, C4, A1, A2, A3, A4, A5, A6, and A7 are sequentially located along the defined circular arc at the respective arc angles of $\phi_C$=−75°, −65°, −55°, −45°, −35°, −25°, −15°, −6°, −3°, 0°, 3°, 6°, 15°, 25°, 35°, 45°, 55°, 65°, and 75°.

For the exemplary embodiment of multi-beam antenna intended for the above described automotive radar antenna application, the first set of waveguide feeds C1-C5 take the form of standard WR10 rectangular waveguide, which has an electrically conducting channel with rectangular cross-sectional dimensions of about 2.540 mm by 1.270 mm (0.10 by 0.50 inches), and an operating bandwidth from about 75 to 110 GHz. The second set of waveguide feeds A1-A7 and B1-B7 take the form of standard WR42 rectangular waveguide, which has an electrically conducting channel with rectangular cross-sectional dimensions of about 10.668 mm by 4.318 mm (0.042 by 0.170 inches), and an operating bandwidth from about 17 to 25 GHz. The reason for the selection of these particular cross-sections for the channels of waveguide feeds A1-A7, B1-B7, and C1-C5 is to enable the long range radar utilizing the waveguide feeds C1-C5 to operate at the required frequency of 77 GHz, and the short range radar utilizing waveguide feeds A1-A7, and B1-B2 to operate at the required frequency of 24 GHz.

From antenna theory, it is know that the half-power or 3 dB beamwidth (BW) for an antenna aperture is given by the expression:

$$BW=K*\lambda*58°/D, \quad (1)$$

where K represents the beam factor for the antenna aperture (typically having a value from about 1.0 to 1.2 depending upon the type of antenna), $\lambda$ represents the free space wavelength of the associate electromagnetic energy, and D represents the dimension of the antenna aperture in the plane defining the BW. In the exemplary embodiment of the present invention, spherical dielectric lens 12 functions as a shared antenna aperture. Accordingly, its diameter represents the dimension D in the above equation (1). Also, for such a spherical aperture, the Applicants have found that a reasonable approximation for the beam factor is K=1.0 for the operating frequencies of interest for multi-beam antenna 10. Accordingly, equation (1) simplifies to:

$$BW=58°\lambda/D, \quad (2)$$

which can be used to determine the appropriate diameter for the spherical lens 12 to produce a radiation beam having a desired beamwidth BW (or shape) for a particular operating frequency f, since λ is determined by the known relationship, fλ=c, with c representing the free space speed of light.

In order for each of the radiation beams in the first group, (corresponding to the first set of waveguide feeds C1-C5) to have the required beamwidth of about 3°, equation (2) indicates that the spherical dielectric lens 12 should have a diameter of about 7.53 cm (3.0 inches). In order for each of the radiation beams in the second group (corresponding to the second set of waveguide feeds A1-A7, and B1-B7) to have the required beamwidth of about 10°, equation (2) indicates that the spherical dielectric lens 12 should have a diameter of about 7.25 cm (2.9 inches). Based on these computations, the diameter of the spherical dielectric lens 12 was selected to be approximately 7.53 cm (3 inches) so that each of the radiation beams in the first and second groups would have beamwidths approximating the respective desired values of about 3° and 10°. Accordingly, the Applicants selected a standard sized 3.0 inch (7.62 cm) diameter Delrin® sphere for dielectric lens 12. As indicated previously, Delrin® is a known material having a relative dielectric constant $\in_r$ of about 2.5 at the required operating frequencies of 24 GHz and 77 GHz.

Figure 5A:
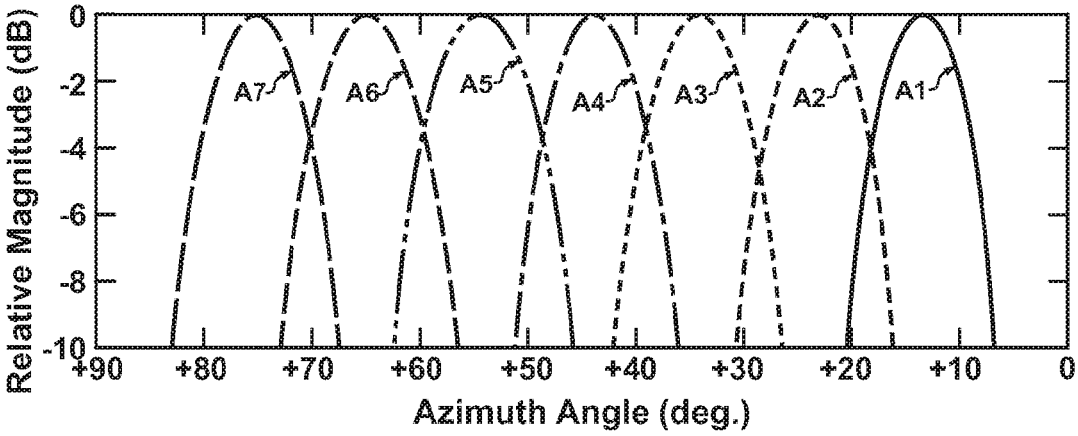
FIGS. 5A-5C show graphical plots of the measured relative magnitudes of each of the radiation beams as a function of azimuth angle for the corresponding individual waveguide feeds of the multi-beam antenna shown in FIG. 1.
Figure 5B:
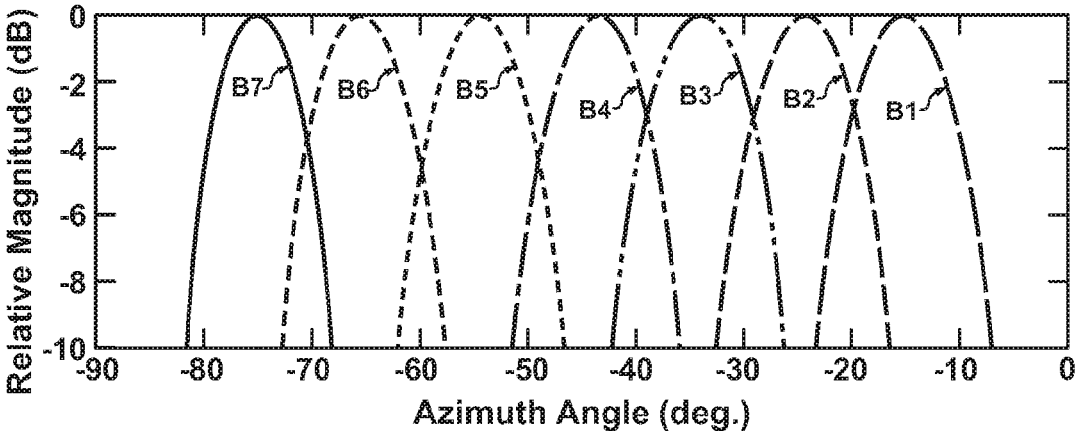
Figure 5C:
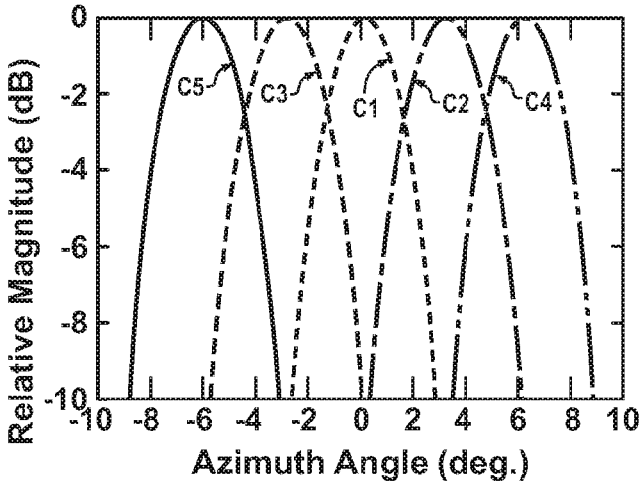

The measured radiation beams produced by the different waveguide feeds A1-A7, B1-B7, and C2-C5 will now be presented. FIGS. 5A-5C shows plots of measured radiation patterns or radiation beams in terms of their relative magnitudes in dB as a function of different azimuth angles $\phi_A$ for each of the different waveguide feeds A1-A7, B1-B7, and C2-C5. In each of these plots the beam peaks were normalized to 0 dB.

FIG. 5A compares the radiation beams for waveguide feeds A1-A7, FIG. 5B compares the radiation beams for waveguide feeds B1-B7, and FIG. 5C compares the radiation beams for waveguide feeds C1-C5. The crossover points of the overlapping radiation beams provided by each set of waveguide feeds can be seen to be in the order of about −3 dB as anticipated.

The radiation beams in FIGS. 5A and 5B were obtained using standard antenna measuring techniques by selectively introducing electromagnetic energy at a frequency of 24 GHz into each of the respective waveguide feeds A1-A7 and B1-B7. In a similar fashion, the radiation beams in FIG. 5C were obtained by selectively introducing electromagnetic energy at a frequency of 77 GHz into the waveguide feeds C1-C5.

FIGS. 6A-6C respectively present Tables 1-3 showing the beam direction in azimuth angle, the directivity, and the azimuth and elevation beamwidths for each of the radiation beams corresponding to the waveguide feeds A1-A7, B1-B7, and C2-C5. Tables 1 and 2 of FIGS. 6A and 6B provide the details for the 24 GHz radiation beams (second group) respectively corresponding to second set of waveguide feeds A1-A7 and B1-B7, and Table 3 of FIG. 6C provides the measured details for the 77 GHz radiation beams (first group) corresponding to first set of waveguide feeds C1-C5.

From these measurements, it will be understood that the uniform dielectric lens 12 that is formed of Delrin®, focuses the electromagnetic energy radiated by waveguide feeds A1-A7, and B1-B7 at 24 GHz to produce the second group of radiation beams having averaged azimuth beamwidths of 9.5°, averaged elevation beamwidths of 9.3°, and averaged beam directivities of 25.6 dB. The dielectric lens 12 also focuses the electromagnetic energy radiated by waveguide feeds C1-C5 at 77 GHz to produce the first group of radiation beams having averaged azimuth beamwidths of 3.4°, averaged elevation beamwidths of 3.4°, and averaged directivities of 33 dB.

The above measured results show that multi-beam antenna 10 depicted in FIGS. 1-3 essentially satisfies the short and long range radar coverage requirements for the above described automotive radar safety system application. The results also demonstrate that spherical dielectric lens 12 functions effectively as a shared antenna aperture in integrating the radiation beams produced by the first and second sets of waveguide feeds that are respectively propagating electromagnetic energy at a first selected frequency of 77 GHz, and a second selected frequency of 24 GHz.

Additional performance measurements were made on multi-beam antenna 10 using standard microwave techniques. It was found that over the frequency range of 22-26 GHz for waveguide feeds A1-A7, and B1-B7, and 76-77 GHz for waveguide feeds C1-C2, the reflection coefficients measured at the respective waveguide feed ports were all less than −10 dB, indicating satisfactory impedance matching characteristics. In addition, the amount of coupling between different ones of the waveguide feeds of multi-beam antenna 10 was measured. Not all of the waveguide feeds could be measured due to physical limitations associated with the size of the waveguide feed ports; however, for those waveguide feeds measured, the coupling coefficients were found to be less than −20 dB, again indicating satisfactory performance for multi-feed antenna 10. As anticipated, the strongest coupling was found to exist between the outer waveguide feed apertures on opposite sides of the surface 24 of antenna feed configuration 14.

The Applicants have found that an integrated multi-beam antenna comprising a dielectric lens and an antenna feed configuration having a plurality of waveguide feeds can provide radiation beams having shapes (as defined by their half power beamwidths) and angular directions based upon the physical and dielectric characteristics of the dielectric lens, the position of the waveguide feed apertures on the surface of the dielectric lens, and the selected frequencies of electromagnetic energy propagating in the waveguide feeds. An embodiment of the multi-beam antenna invention has been shown to essentially satisfy the short and long range radar coverage requirements for a duel frequency automotive radar safety system application.

It will recognize that the radiation beams for the exemplary embodiment of multi-beam antenna 10 described above will essentially be horizontally polarized due to the short walls of the rectangular shaped waveguide channels and corresponding feed apertures being oriented parallel to the azimuthal plane. Those skilled in the art will recognize that these radiation beams could be made vertically polarized, by forming the waveguide feed channels and corresponding feed apertures such that their longer walls are oriented parallel to the azimuthal plane. It will also be understood that each waveguide feed and its corresponding waveguide feed aperture could be orientated to provide different polarizations for their associated radiation beams.

In the above described embodiment of multi-beam antenna 10, the channels of the waveguide feeds were all formed to have rectangular shaped cross-sections. Those skilled in the art will readily recognize that these waveguide feed channels could have cross-sectional shapes other than rectangular, such as circular, or other known waveguide cross-sectional shapes.

It will also be recognized that the open-ends of the waveguide feeds forming the feed apertures could be tapered open or flared to some degree, and/or corrugations could be added to the feed aperture ends to suppress the level of sidelobes associated with their associated radiation beams.

In addition, it will also be recognized that the waveguide feeds in the above illustrated embodiment of multi-feed antenna 10 were all positioned along a circular arc on the surface of the dielectric lens so as to produce radiation beams only in the azimuthal plane, and that multi-beam antenna 10 was operated at two selected frequencies. Those skilled in the art will understand that the principles of the invention can be applied to multi-beam antennas operating at one or more than two frequencies. The principles of the invention can also be applied to multi-beam antennas having waveguide feed apertures positioned on the surface of the dielectric lens to produce radiation beams in directions other than in the azimuthal plane.

While the invention has been described by reference to certain preferred embodiments and implementations, it should be understood that numerous changes could be made within the spirit and scope of the inventive concepts described. Accordingly, it is intended that the invention not be limited to the disclosed embodiments, but that it have the full scope permitted by the language of the following claims.

The invention claimed is:

1. Multi-beam antenna providing a plurality of radiation beams, each radiation beam having a shape and angular direction relative to the antenna, the multi-beam antenna comprising:

a dielectric lens having a surface, and defined physical and dielectric characteristics;

an antenna feed configuration comprising a plurality of waveguide feeds, each waveguide feed having a physical structure for propagating electromagnetic energy at a selected frequency, and opposing ends with one end forming a feed port and the other end forming a feed aperture contiguous with the dielectric lens at a predetermined position along the lens surface; and wherein the shape and angular direction of each of the plurality of radiation beams of the multi-beam antenna are determined by the physical and dielectric characteristics of the dielectric lens, the position the feed aperture a corresponding one of the waveguide feeds on the surface of the dielectric lens, and the frequency of electromagnetic energy propagating in the corresponding one of the waveguide feeds.

2. The multi-beam antenna of claim 1, wherein the dielectric lens is formed to have focusing properties approximating those of a Luneburg lens.

3. The multi-beam antenna of claim 1, wherein the dielectric lens has a substantially spherical shape defined by a diameter, and is formed of a material having a relative dielectric constant in a range from about 2.0 to 3.0.

4. The multi-beam antenna of claim 3, wherein the angular direction of each radiation beam is determined by the position of the feed aperture of the corresponding one of the waveguide feeds on the surface of the dielectric lens.

5. The multi-beam antenna of claim 3, wherein the shape of each radiation beam is defined by an associated half power beamwidth, which is determined by the diameter of the dielectric lens and the selected frequency of electromagnetic energy propagating in the corresponding one of the waveguide feeds.

6. The multi-beam antenna of claim 1, wherein each of the plurality of waveguide feeds is formed as an electrically conducting channel in the feed configuration.

7. The multi-beam antenna of claim 1, wherein the feed configuration comprises a metallic structure containing the plurality of waveguide feeds, with each waveguide feed being formed as an electrically conducting channel within the metallic structure.

8. The multi-beam antenna of claim 7, wherein the metallic structure is shaped to interface with the surface of the dielectric lens, whereby the feed aperture of each waveguide feed is made to be contiguous with the surface of the dielectric lens.

9. The multi-beam antenna of claim 1, wherein the plurality of waveguide feeds comprise a first set for propagating electromagnetic energy at a first selected frequency, and a second set for propagating electromagnetic energy at a second selected frequency.

10. The multi-beam antenna of claim 9, wherein the waveguide apertures of the first set of waveguide feeds are positioned along the lens surface to provide a first group of radiation beams having different respective angular directions in a first predetermined area of angular coverage, and the waveguide apertures of the second set of waveguide feeds are positioned along the lens surface to provide a second group of radiation beams having different respective angular directions in a second predetermined area of angular coverage.

11. The multi-beam antenna of claim 10, wherein the plurality of radiation beams each have respective half power beamwidths, where each radiation beam overlaps at least one other adjacent radiation beam with beam crossover essentially occurring at the respective half power beamwidths of overlapping adjacent radiation beams.

12. The multi-beam antenna of claim 9, wherein the dielectric lens has a substantially spherical shape determined by a diameter, and the shape of each radiation beam in the first group is defined by a first half power beamwidth, which is determined by the diameter of the dielectric lens and the first selected frequency, and the shape of each radiation beam in the second group is defined by a second half power beamwidth, which is determined by the diameter of the dielectric lens and the second selected frequency.

13. Multi-beam antenna providing a plurality of radiation beams, each radiation beam having a half power beamwidth and an angular direction relative to the antenna, the multi-beam antenna comprising:

a dielectric lens having a substantially spherical shape and surface determined by a diameter, the dielectric lens being formed of a material characterized by a relative dielectric constant;

an antenna feed configuration comprising a plurality of waveguide feeds, each waveguide feed formed as an electrically conducting channel for propagating electromagnetic energy at a selected frequency, each electrically conducting channel having opposing ends, with one end forming a feed port and the other end forming a feed aperture contiguous with the dielectric lens at a position along the lens surface; and wherein the angular direction of each radiation beam is adjustable based upon the position of the feed aperture of a corresponding one of the waveguide feeds on surface of the dielectric lens, and the beamwidth of each radiation beam is adjustable based upon the diameter of the dielectric lens and the selected frequency of electromagnetic energy propagating in the electrically conducting channel of the corresponding one of the waveguide feeds.

14. The multi-beam antenna of claim 13, wherein the dielectric constant of the material forming the dielectric lens is in the range of about 2.0 to 3.0.

15. The multi-beam antenna of claim 14, wherein the plurality of waveguide feeds comprise a first set and a second set, where the waveguide apertures of the first set of waveguide feeds are positioned along the lens surface to provide a first group of radiation beams having different respective angular directions in a first predetermined area of angular coverage, and the waveguide apertures of the second set of waveguide feeds are positioned along the lens surface to provide a second group of radiation beams having different respective angular directions in a second predetermined area of angular coverage.

16. The multi-beam antenna of claim 15, wherein the first set of waveguide feeds propagate electromagnetic energy at a first selected frequency and the second set of waveguide feeds propagate electromagnetic energy as a second selected frequency.

17. The multi-beam antenna of claim 16, wherein each radiation beam in the first group has a first half power beamwidth, which is determined by the diameter of the dielectric lens and the first selected frequency, and each radiation beam in the second group has a second half power beamwidth determined by the diameter of the dielectric lens and the second selected frequency.

18. The multi-beam antenna of claim 17, wherein each radiation beam in the first group overlaps with at least one other radiation beam in the first group as determined by the first beamwidth of the radiation beams in the first group, and each radiation beam in the second group overlaps with at least one other radiation beam in the second group based upon the second beamwidth of the radiation beams in the second group.

19. The multi-beam antenna of claim 18, wherein the first predetermined area of angular coverage extends from about −7.5° to 7.5° in an azimuthal plane defined relative to the multi-beam antenna, and the second predetermined area of angular coverage extending from about −80° to −7.5° and from about to 7.5° to 80° in the azimuthal plane.

20. The multi-beam antenna of claim 19, wherein the dielectric lens is formed to have a diameter of about 3.0 inches (7.63 cm), the first selected frequency has a value of about 77 GHz, and the second selected frequency has a value of about 24 GHz, the feed apertures of the waveguide feeds in the first set are positioned to produce corresponding overlapping radiation beams at angular directions of −6°, −3°, 0°, 3°, and 6° in the azimuthal plane, and the feed apertures of the waveguide feeds in the second set are positioned to produce corresponding overlapping radiation beams at angular directions of −75°, −65°, −55°, −45°, −35°, −25°, −15°, 15°, 25°, 35°, 45°, 55°, 65°, and 75° in the azimuthal plane, whereby the multi-beam antenna is adapted to provide the first area of angular coverage for a long range radar and the second area angular coverage for a short range radar in an automotive radar safety system.

* * * * *